US005408299A

United States Patent [19]

Haas

[11] Patent Number: 5,408,299

[45] Date of Patent: Apr. 18, 1995

[54] COLOR PRINTER

[75] Inventor: Werner E. Haas, Webster, N.Y.

[73] Assignee: Xerox Corporation, Stamford, Conn.

[21] Appl. No.: 141,370

[22] Filed: Oct. 28, 1993

[51] Int. Cl.[6] ..... G03G 15/10

[52] U.S. Cl. ..... 355/256; 355/259; 355/327

[58] Field of Search ..... 355/256, 259, 327; 118/661

[56] References Cited

U.S. PATENT DOCUMENTS

| | | | |
|---|---|---|---|
| 3,937,177 | 2/1976 | Lloyd | 118/50 |
| 4,021,586 | 5/1977 | Matkan | 118/661 X |
| 4,202,913 | 5/1980 | Klavan et al. | 118/661 X |
| 4,403,848 | 9/1983 | Snelling | 355/327 |
| 4,686,936 | 8/1987 | Chow | 118/661 |
| 4,833,503 | 5/1989 | Snelling | 355/259 |
| 4,994,858 | 2/1991 | Lubberts | 355/327 X |
| 5,063,398 | 11/1991 | Murai et al. | 355/327 X |
| 5,089,853 | 2/1992 | Uematsu | 355/256 |
| 5,109,794 | 5/1992 | Komatsu et al. | 355/256 X |
| 5,155,528 | 10/1992 | Morishige et al. | 355/256 X |

*Primary Examiner*—Fred L. Braun

*Attorney, Agent, or Firm*—H. Fleischer; J. E. Beck; R. Zibelli

[57] ABSTRACT

A printing machine in which a recording medium has a latent image recorded thereon. A housing stores a supply of liquid developer material therein. The housing is operatively associated with a donor member for substantially uniformly coating liquid developer material thereon. The donor member is spaced from the recording medium. As the donor member moves, it transports the developer material to a development zone wherein the latent image recorded on the recording medium attracts at least the toner thereto to form a developed image thereon. A multicolor image may be formed by repeating this process for different developer materials.

6 Claims, 2 Drawing Sheets

COLOR PRINTER

This invention relates generally to a color printing machine, and more particularly concerns a development system for developing images with a liquid developer material comprising at least a liquid carrier having toner particles dispersed therein.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated area, to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with a dry developer material comprising carrier granules having toner particles adhering triboelectrically thereto. The toner particles are attracted to the latent image forming a visible powder image on the photoconductive surface. After the electrostatic latent image is developed with the toner particles, the toner powder image is transferred to a copy sheet. Thereafter, the toner powder image is heated to permanently fuse it to the copy sheet. Alternatively, the electrostatic latent image may be developed by furnishing a liquid ink developer material thereto.

Another type of printing process is electrostatic printing which involves utilizing a plurality of closely spaced electrodes or styli opposed from a wide electrode across which an electrical potential is selectively applied sufficient to ionize the air, gas or other fluid therebetween. An insulating web or sheet is passed between these electrodes, or alternatively, the electrodes are passed over the insulating web or sheet, and when the electrodes are energized an electrostatic charge is deposited on the web or sheet in the electrode configuration on the area between the energized electrodes. In this manner, a charge pattern is formed on the dielectric material in accordance with the presence, absence, or intensity of the potential applied across the electrodes. The charge pattern, or electrostatic latent image, may then be developed into visual form by the application to the web or sheet of toner particles, which adhere in conformance with the latent image. The resultant developed image is then fused permanently affixing the toner powder image to the sheet.

In either type of printing machine, it is highly desirable to be capable of producing color prints. In order to be capable of producing a color copy, it is frequently necessary to form color separations. For example, a blue color separation image is first made, developed with yellow toner, and transferred to the sheet. Then, a second green color separation image is made, developed with magenta toner and transferred to the same sheet in superimposed registration with the first color separation image. A third red color separation is then made, developed with cyan toner and transferred to the sheet in superimposed registration with the previously transferred blue and green color separation images. Finally, if desired, a black separation image is made and developed with black toner and transferred to the sheet having the previously transferred color images thereon. In this way, a permanent color print is formed.

In the foregoing types of printing machines, it is desirable to be capable of utilizing a liquid developer material. In order to successfully utilize liquid developer materials, the development systems must be capable of handling the liquid material. Various types of color printing machines, electrostatic printing machines, and liquid development systems have heretofor been employed. The following disclosures appear to be relevant:

U.S. Pat. No. 3,937,177 Patentee: Lloyd Issued: Feb. 10, 1976

U.S. Pat. No. 4,403,848 Patentee: Snelling Issued: Sep. 13, 1983

U.S. Pat. No. 4,686,936 Patentee: Chow Issued: Aug. 18, 1987

U.S. Pat. No. 4,833,503 Patentee: Snelling Issued: May 23, 1989

The relevant portions of the foregoing patents may be briefly summarized as follows:

U.S. Pat. No. 3,937,177 discloses a toner fountain and recovery system for use with an electrostatic printing machine. A fountain and supply arrangement is provided for applying liquid toner material to a surface of a web of print material passing across the fountain. A vacuum operated recovery head is disposed to extend transversely across the web. The recovery head removes toner from the surface of the web. A column of toner fluid forms a fluid head in fluid communication with a flow passage coupled to the recovery head so as to permit the height of the hydraulic head to establish the degree of vacuum applied to the recovery head.

U.S. Pat. No. 4,403,848 and U.S. Pat. No. 4,833,503 disclose a multicolor electrophotographic printing machine in which a color separation latent image is formed on a photoconductive belt and developed with the appropriately colored toner particles. Thereafter, successive color separated latent images are formed and developed in superimposed registration with one another. In this way, a composite multicolor latent image is formed on the photoconductive belt and subsequently transferred to a sheet. The composite image on the sheet is then fused thereto.

U.S. Pat. No. 4,686,936 discloses an electrophotographic printing machine employing a liquid development system. A gravure roll in engagement with the photoconductive belt and having a portion of the photoconductive belt wrapped about a portion of the exterior circumferential surface of the roll, advances a liquid developer material into the development zone so as to develop the latent image recorded on the photoconductive belt.

In accordance with one aspect of the features of the present invention, there is provided a printing machine including a recording medium adapted to have a latent image recorded thereon. A housing stores a supply of liquid developer material comprising a liquid carrier having toner particles dispersed therein. A donor member is spaced from the recording medium. The donor member is operatively associated with the housing so as to be coated with the liquid developer material. The donor member is movable to transport the developer material to a region opposed from the recording medium so that the latent image recorded thereon attracts at least the toner particles thereto to form a developed image on the recording medium.

Other aspects of the present invention will become apparent as the following description proceeds and upon reference to the drawings, in which.

Figure 1:
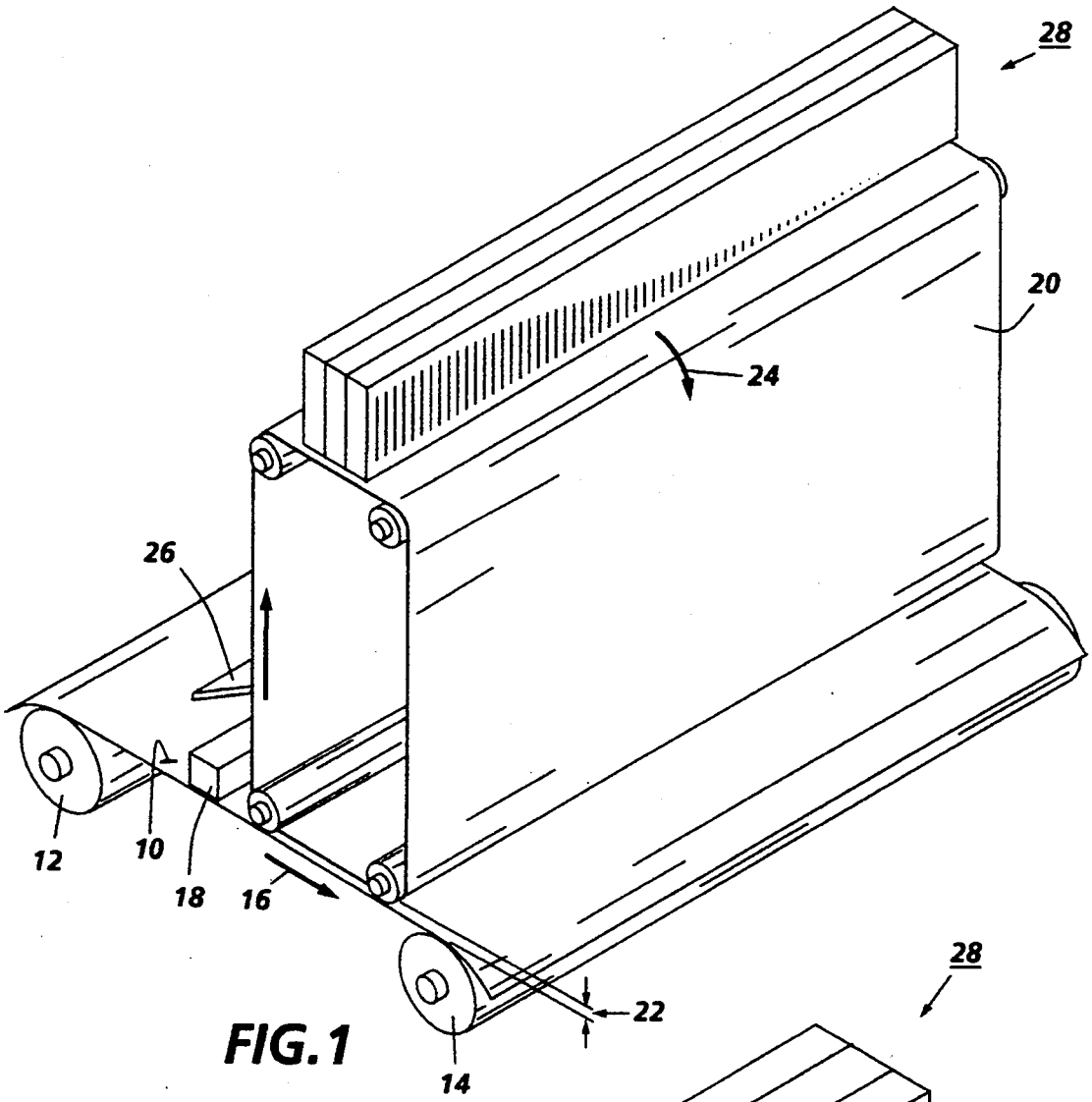
FIG. 1 is a perspective view depicting an electrostatic printing machine incorporating the features of the present invention therein.

While the present invention will hereinafter be described in connection with various embodiments thereof, it will be understood that it is not intended to limit the invention to these embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements.

Turning now to FIG. 1, a web of paper is advanced by rolls 12 and 14. As the web of paper advances in the direction of arrow 16, it passes beneath an electrostatic printhead 18. One type of suitable electrostatic printhead includes a recording head and a back-up assembly. The recording head consists essentially of a pair of opposed fiber glass plates secured to one another and having embedded therebetween an array of evenly spaced conductors arranged to protrude slightly on their upper edge to form conductive nibs. The tips or nibs are exposed in a line extending across the web of paper. Discrete tips are electrically energized to record the desired electrostatic latent image on the web of paper. Various types of electrostatic recording heads may be utilized. Suitable recording heads are described in U.S. Pat. No. 3,686,678 issued to Robins et al. in 1972; U.S. Pat. No. 3,693,185 issued Lloyd in 1972; U.S. Pat. No. 3,729,123 issued to Lloyd in 1973; U.S. Pat. No. 3,793,107 issued to Lloyd in 1974; and U.S. Pat. No. 3,937,177 issued to Lloyd in 1976, the relevant portions of the foregoing patents being hereby incorporated into the present application by reference thereto.

After the electrostatic latent image is recorded on the web of paper, the latent image advances to the development station. At the development station, a donor belt 20 having a liquid developer material coated across the entire surface thereof advances the liquid developer material to a development zone 22. At development zone 22, donor belt 20 is spaced from the web of paper 10. The electrostatic latent image recorded on the web of paper attracts toner particles from the liquid developer material to form a toner image on the web of paper. Thereafter, the web of paper is advanced by rolls 12 and 14 in the direction of arrow 16. In the event a multicolor image is being formed, roll 14 and roll 12 reverse their direction of rotation so as to return the web of paper to the electrostatic printhead where a second electrostatic latent image is recorded thereon. The second electrostatic latent image is subsequently developed by donor belt 20 with another color developer material. The foregoing process is repeated until all of the electrostatic latent images have been developed with different color toner with the toner being in superimposed registration with one another to form a composite multicolor image on the paper. After each electrostatic latent image is developed, donor belt 20 continues to advance in the direction of arrow 24 to the cleaning station. At the cleaning station, a cleaning blade 26 removes the liquid developer material from donor belt 20. In this way, new liquid developer material may be coated thereon by the liquid developer material cartridge 28. In black and white printing, liquid developer cartridge 28 includes only a black liquid developer material. However, in multicolor printing, liquid developer cartridge 28 includes, at a minimum, three different color liquid developer housings. The foregoing is shown more clearly in FIG. 2.

Figure 2:
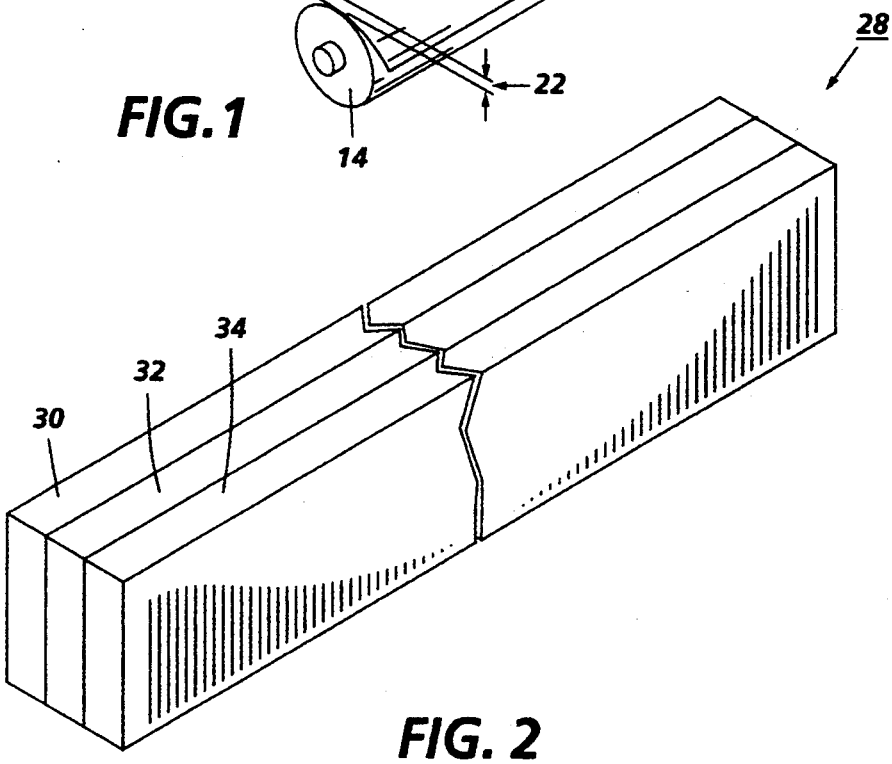
FIG. 2 is a perspective view illustrating the liquid developer material supply for the development system of the FIG. 1 printing machine.

Turning now to FIG. 2, there is shown liquid developer cartridge 28 in further detail. As shown thereat, liquid developer cartridge 28 includes a housing 30 storing a supply of cyan liquid developer material, a housing 32, storing a supply of magenta liquid developer material and a housing 34 storing a supply of yellow liquid developer material. In addition, there may be a forth housing storing a supply of black liquid developer material. This depends upon whether black will be formed by an undercolor removal process or by a process in which equal portions of cyan, magenta and yellow are superimposed over one another to form a process black. By way of example, the liquid developer material may comprise an insulating carrier liquid which may be a hydracarbon liquid, although other insulating liquids may also be employed. A suitable hydrocarbon liquid is an Isopar, which is a trademark of the Exxon Corporation. These are branched, chained, alaphatic hydrocarbon liquids (largely decane). The toner particles comprise a binder and a pigment. The pigment may be of any suitable color. However, one skilled in the art will appreciate that any suitable liquid developer material may be employed. One such suitable developer material is described in U.S. Pat. No. 4,582,774 issued to Landa in 1986, the relevant portions thereof being hereby incorporated into the present application.

Figure 3:
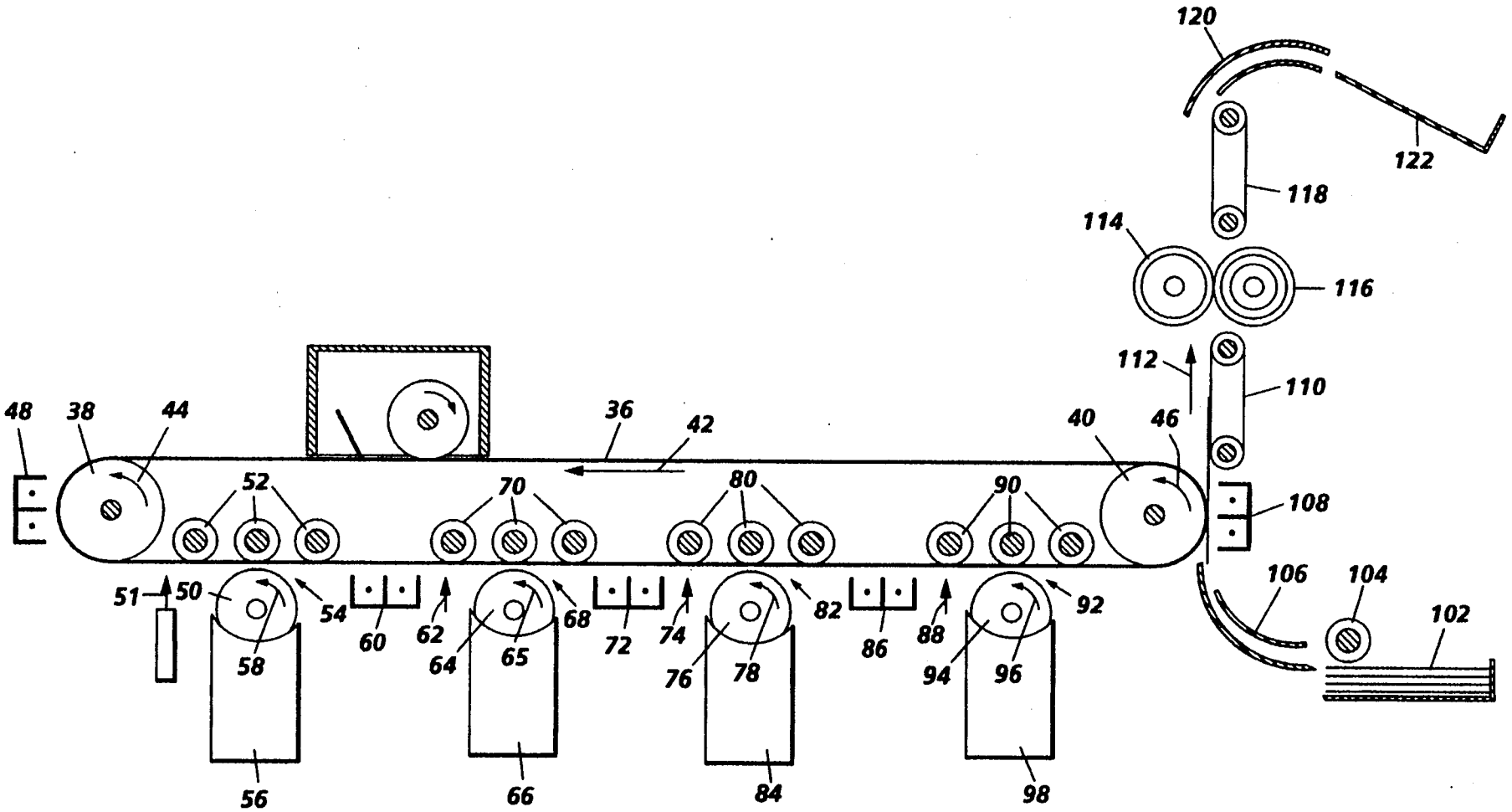
FIG. 3 is a schematic elevational view depicting a multicolor electrophotographic printing machine incorporating the features of the present invention therein.

Referring now to FIG. 3, there is shown a multicolor electrophotographic printing machine incorporating the features of the present invention therein. The printing machine employs a belt 36 having a photoconductive surface deposited on a conductive substrate. Preferably, the photoconductive surface is made from a selenium alloy with the conductive substrate being made preferably from an aluminum alloy which is electrically grounded. Belt 36 advances successive portions of the photoconductive surface sequentially through the various processing stations disposed about the path of movement thereof. The support assembly for belt 36 includes two rollers, 38 and 40. These rollers are spaced apart with roller 38 being rotatably driven by a suitable motor and drive (not shown) so as to rotate and advance belt 36 in the direction of arrow 42. Roll 38 rotates in the direction of arrow 44 and roll 40 rotates in the direction of arrow 46.

Initially, belt 36 passes through a charging station. At the charging station, a corona generating device 48 charges the photoconductive surface of belt 36 to relatively high, substantially uniform potential.

After the photoconductive surface of belt 36 is charged, the charged portion thereof is advanced to an exposure station. At the exposure station, an imaging beam 51 generated by a raster output scanner (ROS) employing a laser with rotating polygon mirror blocks to create a color separated electrostatic latent image on the photoconductive surface of belt 36. This color separated electrostatic latent image is developed by donor roll 50 with cyan liquid developer material. A plurality of idler rollers 52 locate photoconductive belt 36 precisely with respect to donor roll 50. In this way, there is a space between donor roll 50 and photoconductive belt 36 in development zone 54. Cyan toner is attracted from donor roll 50, across the space in development zone 54, to the electrostatic latent image recorded on the photoconductive surface of belt 36. A cyan liquid developer cartridge 56 coats donor roll 50 with cyan liquid developer material. The entire circumferential surface of donor roll 50 is coated with the cyan liquid developer material. A cleaning blade, not shown, removes the liquid developer material from the donor roll after being transported through the development zone. Donor roll 50 is electrically biased to a suitable magnitude and polarity and rotates in the direction of arrow 58.

After the cyan toner image has been developed on the photoconductive surface of belt 36, belt 36 continues to advance in the direction of arrow 42 to a recharge station where corona generating device 60 recharges the photoconductive surface of belt 36 to a relatively, substantially uniform potential. Thereafter, at the next exposure station, an imaging beam 62 from the ROS selectively dissipates the charge to record another partial electrostatic latent image on the photoconductive surface of belt 36 corresponding to regions to be developed with a magenta liquid developer material. This partial electrostatic latent image may be totally or partially in superimposed registration with the developed cyan image on the photoconductive surface of belt 36. This partial electrostatic latent image is now advanced to the next successive development station which deposits magenta toner thereon. The magenta liquid development station employs a donor roll 64 having a magenta liquid developer cartridge 66 associated therewith. The magenta liquid cartridge coats donor roll 64 with magenta colored liquid developer material. Once again, donor roll 64 is spaced from the photoconductive surface of belt 36 at development zone 68. Donor roll 64 rotates in the direction of arrow 65 and is electrically biased to a suitable magnitude and polarity. Here, also, idler rollers 70 precisely locate the photoconductive surface of belt 36 so as to form a gap in development zone 68 between donor roll 64. A cleaning blade has its free end adjacent the surface of the donor roll to remove the liquid developer material therefrom after developing the electrostatic latent image.

After the electrostatic latent image has been developed with magenta toner, the photoconductive surface is advanced with belt 36 in the direction of arrow 42 to the next recharge station. At this recharge station, a corona generating device 72 charges the photoconductive surface of belt 36 to a relatively high, substantially uniform potential. Thereafter, an imaging beam 74 from the ROS selectively discharges the charge on the photoconductive surface to record a partial electrostatic latent image for development with yellow toner. This latent image may be partially or totally in superimposed registration with the prior cyan and magenta developed images on the photoconductive surface. After the latent image is developed on the photoconductive surface, belt 36 advances the latent image to the yellow developer station. At the yellow developer station, a donor roll 76 rotating in the direction of arrow 78 transports yellow liquid developer material to the development zone. Idler rollers 80 support belt 36 so that the photoconductive surface is spaced from donor roll 76 at development zone 82. Donor roll 76 is electrically biased to a suitable polarity and magnitude so that the yellow toner is attracted from the liquid developer material across the gap in development zone 86 onto the electrostatic latent image. In this way, a yellow toner image is formed on the photoconductive surface of belt 36 in superimposed registration with the previously developed cyan and magenta images. Yellow liquid developer cartridge 84 dispenses yellow liquid developer material onto the surface of donor roll 76. In this way, the surface of donor roll 76 is substantially uniformly coated with the developer material. A cleaning blade (not shown) removes the liquid developer material from the surface of the donor roll after the latent image has been developed with yellow toner.

After the yellow toner image has been formed on the photoconductive surface of belt 36, belt 36 advances to the next recharge station where corona generator 86 recharges the photoconductive surface to a relatively high, substantially uniform potential. Thereafter, imaging beam 88 selectively discharges those portions of the charged photoconductive surface which are to be developed with black toner. This is a black undercolor removal process which is well known in the art. The latent image to be developed with black toner is advanced to the black development station. At the black development station, idler rollers 90 precisely position the photoconductive surface of belt 36 so as to form a space in development zone 92 between the photoconductive surface and donor roll 94. Donor roll 94 is substantially uniformly coated with black liquid developer material by the black liquid developer cartridge 98. Donor roll 94 rotates in the direction of arrow 96 to advance the black liquid developer material to development zone 92. A suitable electrical bias is applied to donor roll 94 so as to electrically bias it to the proper magnitude and polarity permitting black toner to be attracted therefrom to the electrostatic latent image recorded on the photoconductive surface of belt 36. A cleaning blade (not shown) removes the black liquid developer material after the latent image has been developed. This last, black, developed image is located only on those portions of the photoconductive surface adapted to have black in the printed page. It is not superimposed over the prior cyan, magenta, and yellow developed images. In this way, a composite multicolor toner image is formed on the photoconductive surface of belt 36. This composite multicolor developed image is advanced to the transfer station.

At the transfer station, a sheet of support material, i.e. paper, is advanced from a stack 102 by a feed roll 104. The sheet advances through a chute 106 and is guided to the transfer station thereby. A corona generating device 108 sprays ions onto the back side of the paper. This attracts the composite multicolor developed image from the photoconductive surface of belt 36 to the sheet of paper. A conveyor belt 110 moves the sheet of paper in the direction of arrow 112 to a drying station. While transferring the composite multicolor developed image to a sheet of paper has been described, one skilled in the art will appreciate that the developed image may be transferred to an intermediate member, such as a belt or drum, and then, subsequently, transferred and fused to the sheet of paper.

The drying station includes a heated roll 114 and back-up or pressure roll 116 resiliently urged into engagement therewith to form a nip through which the sheet of paper passes. In the drying operation, the liquid carrier is vaporized and the toner particles coalesce with one another and bond to the sheet of paper in image configuration forming a multicolor image thereon. After drying, the finished sheet is discharged onto a conveyor 118. Conveyor 118 transports the sheet to a chute 120 which guides the sheet into a catch tray 122 for removal therefrom by the machine operator.

In recapitulation, it is clear that the present invention is directed to a development system employing a donor roll coated with a liquid developer material. The donor belt or roll is spaced from a recording medium having a latent image recorded thereon. The donor member is electrically biased to a suitable polarity and magnitude so that the toner is attracted from the developer material adhering to the donor member to the recording medium. A liquid toner cartridge is operatively associated with the donor belt or roll so as to substantially uniformly coat the exterior surface thereof with liquid developer material. Toner is attracted from the liquid developer material to the electrostatic latent image. In this way, the recording medium is developed with suitably colored toner.

It is, therefore, apparent that there has been provided in accordance with the present invention a liquid development system which fully satisfies the aims and advantages hereinbefore set forth. While this invention has been described in conjunction with specific embodiments for use in various types of printing machines, it is evident that many alternatives, modifications and variations will be apparent to those skilled in the art. Accordingly, it is intended to embrace all such alternatives, modifications and variations that fall within the spirit and broad scope of the appended claims.

I claim:

1. A printing machine, including:

a recording medium adapted to have a latent image recorded thereon;

a housing storing a supply of liquid developer material comprising a liquid carrier having toner particles dispersed therein, said housing storing a plurality of different color liquid developer materials; and a donor member, spaced from said recording medium to define a gap there between, operatively associated with said housing so as to be coated with the liquid developer material, said donor member being movable to transport the developer material to a region opposed and spaced from said recording medium so that the latent image recorded thereon attracts the toner particles across the gap to form a developed image on said recording medium, said housing, coating said donor member with different color liquid developer materials so as to develop different latent images recorded on said recording medium in different colors.

2. A printing machine according to claim 1, wherein said recording medium includes a sheet.

3. A printing machine according to claim 2, further including an electrostatic recording head adapted to record the latent image on said sheet.

4. A printing machine according to claim 3, wherein said donor member includes a donor belt.

5. A printing machine according to claim 3, wherein said donor member includes a donor roll.

6. A printing machine according to claim 1, wherein said donor member deposits different color toner particles on the different latent images in superimposed registration with one another to form a composite multicolor developed image.

* * * * *